US009228374B2

(12) United States Patent
Huang

(10) Patent No.: US 9,228,374 B2
(45) Date of Patent: Jan. 5, 2016

(54) LOCK STRUCTURE AND GUIDANCE MECHANISM THEREOF

(71) Applicant: TAIWAN FU HSING INDUSTRIAL CO., LTD., Kaohsiung (TW)

(72) Inventor: Chao-Ming Huang, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 396 days.

(21) Appl. No.: 13/671,749

(22) Filed: Nov. 8, 2012

(65) Prior Publication Data

US 2013/0298614 A1 Nov. 14, 2013

(30) Foreign Application Priority Data

May 8, 2012 (TW) ..... 101116427 A

(51) Int. Cl.

| | |
|---|---|
| ***E05B 1/00*** | (2006.01) |
| ***E05B 65/00*** | (2006.01) |
| ***E05B 55/00*** | (2006.01) |
| *E05B 55/04* | (2006.01) |
| *E05B 17/00* | (2006.01) |

(52) U.S. Cl.

CPC ..... *E05B 65/00* (2013.01); *E05B 55/005* (2013.01); *E05B 2017/0095* (2013.01); *Y10T 70/5155* (2015.04)

(58) Field of Classification Search

CPC ..... E05B 55/005
USPC ..... 292/336.3, 347, DIG. 37; 70/467, 468, 70/473, 476, 478–484
See application file for complete search history.

(56) References Cited

U.S. PATENT DOCUMENTS

| | | | | | |
|---|---|---|---|---|---|
| 2,231,908 | A | * | 2/1941 | Heizmann | 70/153 |
| 2,264,239 | A | * | 11/1941 | Hirsh | 70/476 |
| 2,743,123 | A | * | 4/1956 | Alexander | 292/1 |
| 2,950,615 | A | * | 8/1960 | Schlage et al. | 70/216 |
| 4,920,773 | A | * | 5/1990 | Surko, Jr. | 70/224 |
| 5,232,255 | A | * | 8/1993 | Palmer et al. | 292/336.3 |
| 5,284,372 | A | * | 2/1994 | Lin | 292/336.3 |
| 5,460,417 | A | * | 10/1995 | Zuckerman | 292/175 |
| 5,784,909 | A | * | 7/1998 | Huang | 70/224 |
| 5,816,086 | A | * | 10/1998 | Russell, IV | 70/422 |

(Continued)

FOREIGN PATENT DOCUMENTS

| | | | |
|---|---|---|---|
| CA | 2529547 | A1 * | 8/2006 |
| CN | 2539811 | Y | 3/2003 |

(Continued)

OTHER PUBLICATIONS

Taiwanese Office Action mailed Jun. 17, 2014 for Taiwanese Patent Application No. 101116427, 9 pages.

(Continued)

*Primary Examiner* — Carlos Lugo
(74) *Attorney, Agent, or Firm* — Jackson IPG PLLC; Damian K. Jackson

(57) ABSTRACT

A lock structure at least includes a driving plank and a guidance mechanism. The guidance mechanism and the driving plank are mutually coupled at a same unlatch position via the guidance mechanism, or, the guidance mechanism and the driving plank are mutually coupled at a same lock position, which prevents the driving plank from wrong installation to avoid a destruction of the lock structure or reinstallation.

11 Claims, 17 Drawing Sheets

(56) References Cited

U.S. PATENT DOCUMENTS

| | | | | |
|---|---|---|---|---|
| 5,904,232 | A * | 5/1999 | Shen | 192/69.62 |
| 5,934,117 | A * | 8/1999 | Shen | 70/224 |
| 5,941,108 | A * | 8/1999 | Shen | 70/467 |
| 5,987,947 | A * | 11/1999 | Shen | 70/467 |
| 5,992,189 | A * | 11/1999 | McCaa | 70/149 |
| 6,536,249 | B2 * | 3/2003 | Wu | 70/467 |
| 6,623,053 | B1 * | 9/2003 | Hwang | 292/336.3 |
| 7,934,754 | B2 * | 5/2011 | Mathachan | 292/347 |
| 8,479,544 | B2 * | 7/2013 | Liu | E05B 55/005 292/336.3 |
| 8,491,023 | B2 * | 7/2013 | Brannaman et al. | 292/347 |
| 2002/0149211 | A1 | 10/2002 | Budhrani | |
| 2006/0156770 | A1 * | 7/2006 | Huang et al. | 70/224 |
| 2009/0000342 | A1 * | 1/2009 | Chen | 70/224 |
| 2013/0145800 | A1 * | 6/2013 | Liu et al. | 70/91 |

FOREIGN PATENT DOCUMENTS

| | | | |
|---|---|---|---|
| CN | 200992836 | Y | 12/2007 |
| EP | 1076142 | A1 | 2/2001 |
| GB | 2291929 | A | 2/1996 |
| TW | M254491 | | 1/2005 |
| TW | M276083 | | 9/2005 |
| TW | M278745 | | 10/2005 |
| TW | M291996 | | 6/2006 |
| TW | M350580 | | 2/2009 |
| TW | M423723 | | 3/2012 |

OTHER PUBLICATIONS

Chinese Office Action mailed Feb. 12, 2015 for Chinese Patent Application No. 201210217220.0, 5 pages.

* cited by examiner

LOCK STRUCTURE AND GUIDANCE MECHANISM THEREOF

FIELD OF THE INVENTION

The present invention is generally related to a lock structure, which particularly relates to the lock structure that makes a driving plank correctly installed via a guidance track of a guidance mechanism.

BACKGROUND OF THE INVENTION

With reference to FIG. 22, a conventional lock structure 10 includes a driving plank 11, an unlatch plate 12, an elastic member 13 and a controlled barrel 14, wherein the unlatch plate 12 and the elastic member 13 are disposed within the controlled barrel 14. The unlatch plate 12 comprises a transmission hole 12*a* and cooperates with an unlatch button coupled to an inside lever. In manufacturing process of the lock structure 10, manufacturer must ensure that the driving plank 11 and the transmission hole 12*a* of the unlatch plate 12 are aligned in a same installation direction so as to make the driving plank 11 directly inserted into the transmission hole 12*a*. Eventually, the lock structure 10 can be wrapped in and approves for delivery.

However, prior to lock structure installation by a consumer, the unlatch button may be unaware of being compressed by the consumer to lead the unlatch plate 12 into rotation in advance, which makes the driving plank 11 not aligned in the same installation direction with the transmission hole 12*a* of the unlatch plate 12. Referring to FIG. 22, owing to the driving plank 11 not inserted into the transmission hole 12*a* of the unlatch plate 12, the driving plank 11 simply compresses the unlatch plate 12. Therefore, a lock state or an unlock state of the lock structure 10 fails to operate for the reason that the unlatch plate 12 is incapable of actuating the driving plank 11. Besides, a wrong installation for the driving plank 11 results in destruction of the lock structure 10 or reinstallation.

SUMMARY

The primary object of the present invention is to provide a lock structure, wherein a guidance mechanism of the lock structure includes an opening and a guidance track. A driving plank enables to be installed at the lock structure via the guidance track, which prevents the driving plank from wrong installation to avoid a destruction of the lock structure or reinstallation.

A lock structure in the present invention at least includes a driving plank and a guidance mechanism, wherein the driving plank is rotatable between an unlatch position and a lock position, and the guidance mechanism is rotatable between the unlatch position and the lock position as well. The guidance mechanism includes an opening and a guidance track, the driving plank is inserted into the opening of the guidance mechanism to make the guidance mechanism and the driving plank mutually coupled at the same unlatch position or mutually coupled at the same lock position through the guidance of the guidance track, which prevents the driving plank from wrong installation to avoid a destruction of the lock structure or reinstallation.

DETAILED DESCRIPTION OF THE INVENTION

Figure 1:
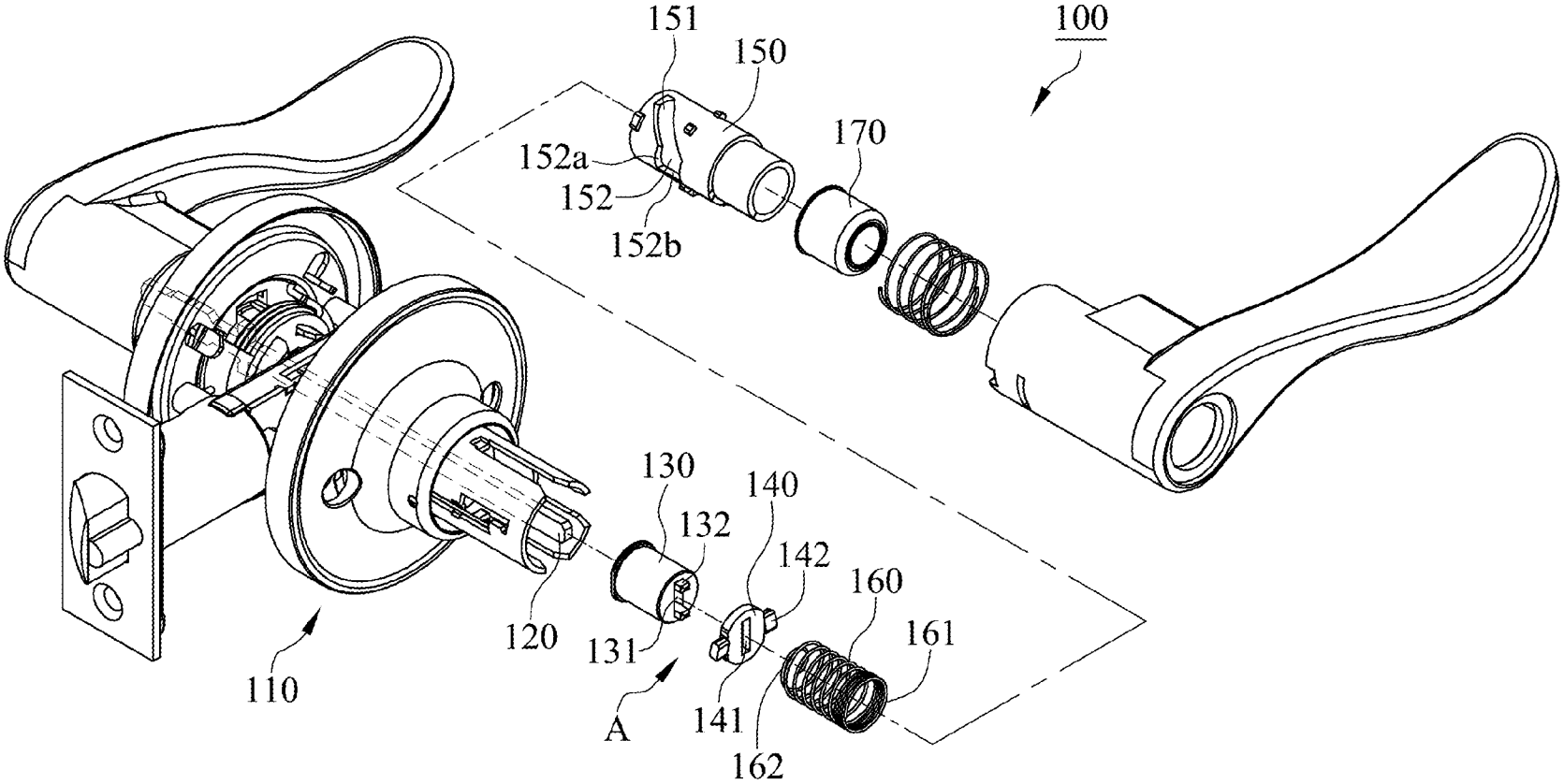
FIG. 1 is a perspective exploded diagram illustrating a lock structure in accordance with a first embodiment of the present invention.

With reference to FIG. 1, a lock structure 100 in accordance with a first embodiment of the present invention includes a latch module 110, a driving plank 120, an actuation member 170, and a guidance mechanism A, wherein one end of the driving plank 120 couples to an outside lever where a key is inserted to unlock, and another end of the driving plank 120 couples to the guidance mechanism A which is coupled to an inside lever. The latch module 110 may be driven to unlatch a door by rotation of the inside lever or the outside lever. Despite the lock structure 100 installed at the inside lever and the outside lever in this embodiment, the lock structure 100 may also be installed at an inside knob and an outside knob based on actual demand. The driving plank 120 couples to the latch module 110 and is rotatable between an unlatch position and a lock position so that the lock structure 100 can be switched into a locked state or an unlocked state. The guidance mechanism A and the driving plank 120 are synchronously rotatable, and the guidance mechanism A is rotatable between the unlatch position and the lock position.

In this embodiment, the guidance mechanism A includes a leading barrel 130 and an unlatch plate 140.

Figure 5:
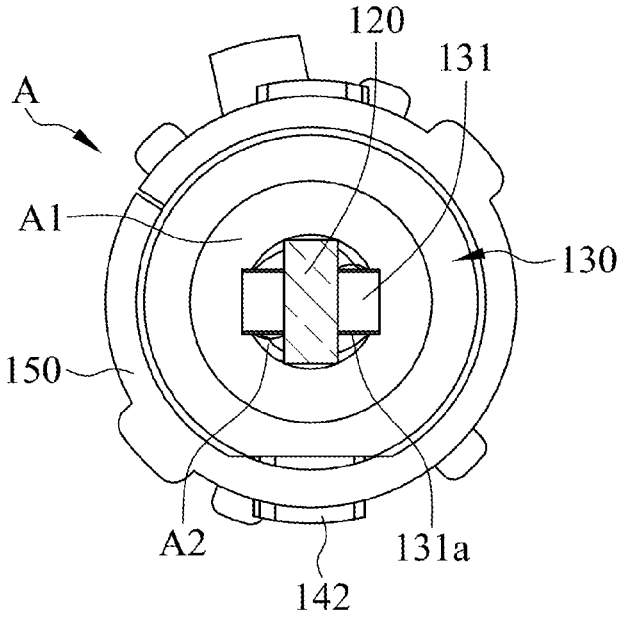
FIG. 5 is a top view illustrating a driving plank in contact with a leading barrel in accordance with a first embodiment of the present invention.

With reference to FIGS. 1 and 5, in this embodiment, the lock structure 100 further includes a control barrel 150 and an elastic member 160, wherein the unlatch plate 140 and the elastic member 160 are disposed within the control barrel 150, the unlatch plate 140 comprises a transmission hole 141 and a side plate 142, the control barrel 150 comprises a guiding slot 151 and an alignment slot 152 in communication with the guiding slot 151, and the side plate 142 is selectively movable between the guiding slot 151 and the alignment slot 152. The elastic member 160 comprises a first end portion 161 and a second end portion 162, the first end portion 161 contacts against the control barrel 150, and the second end portion 162 contacts against the unlatch plate 140.

Figure 2:
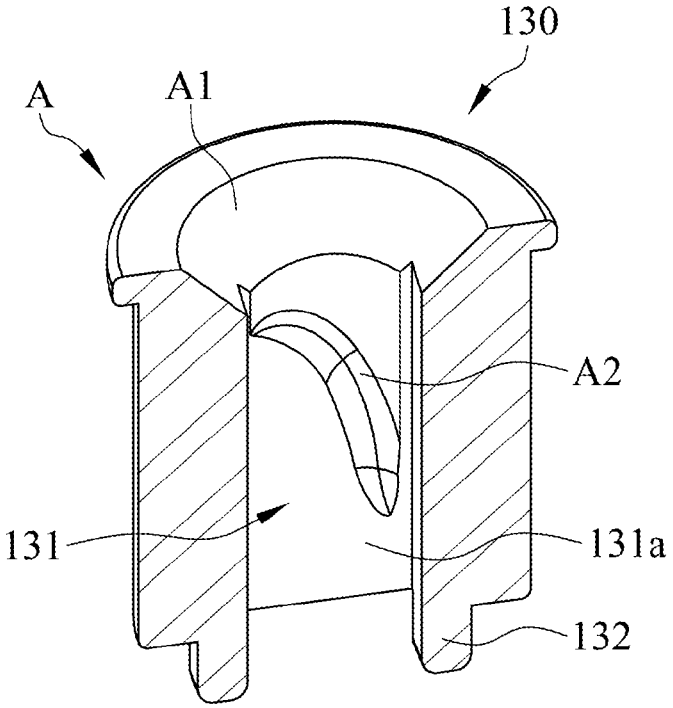
FIG. 2 is a perspective section view illustrating a leading barrel in accordance with a first embodiment of the present invention.
Figure 3:
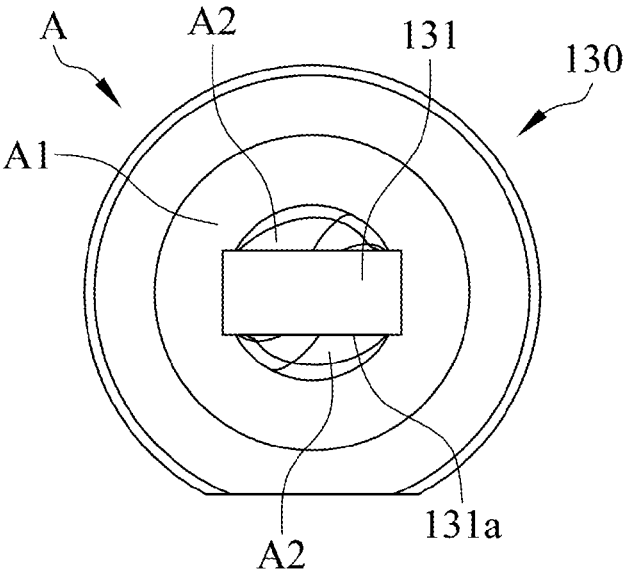
FIG. 3 is a top view illustrating a leading barrel in accordance with a first embodiment of the present invention.

Referring to FIGS. 1, 2 and 3, the guidance mechanism A includes an opening A1 and a guidance track A2. In this embodiment, the opening A1 and the guiding track A2 are disposed at the leading barrel 130, the leading barrel 130 includes an alignment hole 131, the guiding track A2 is in communication with the opening A1 and the alignment hole 131, and the alignment hole 131 at least comprises a lateral surface 131*a*. In this embodiment, the guiding track A2 is disposed at the lateral surface 131*a* of the alignment hole 131, and the guidance track A2 is a spiral track (e.g. a track with internal thread).

With regard to the guidance mechanism A, the driving plank 120 and the actuation member 170, a table list below illustrates the detailed description of unlatch position and lock position.

Figure 20:
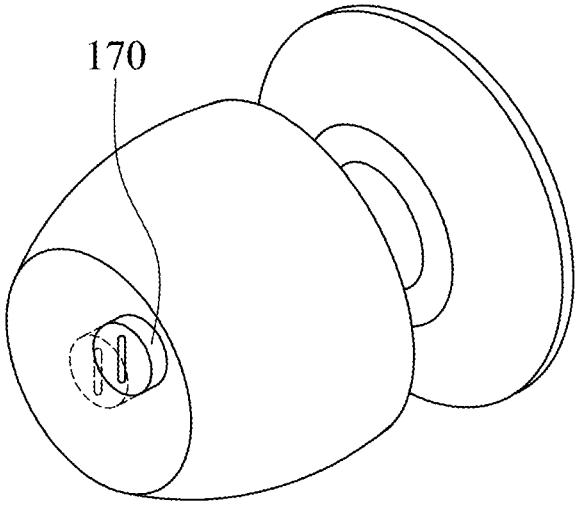
FIG. 20 is a perspective view illustrating a push button of a cylindrical lock situated in a pushed state.
Figure 21:
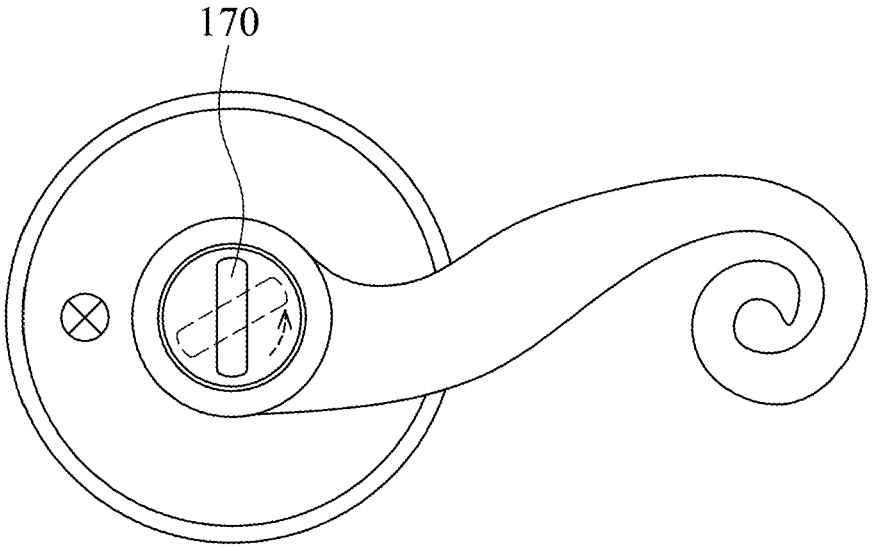
FIG. 21 is a front view illustrating a thumbturn situated in vertical direction.
Figure 22:
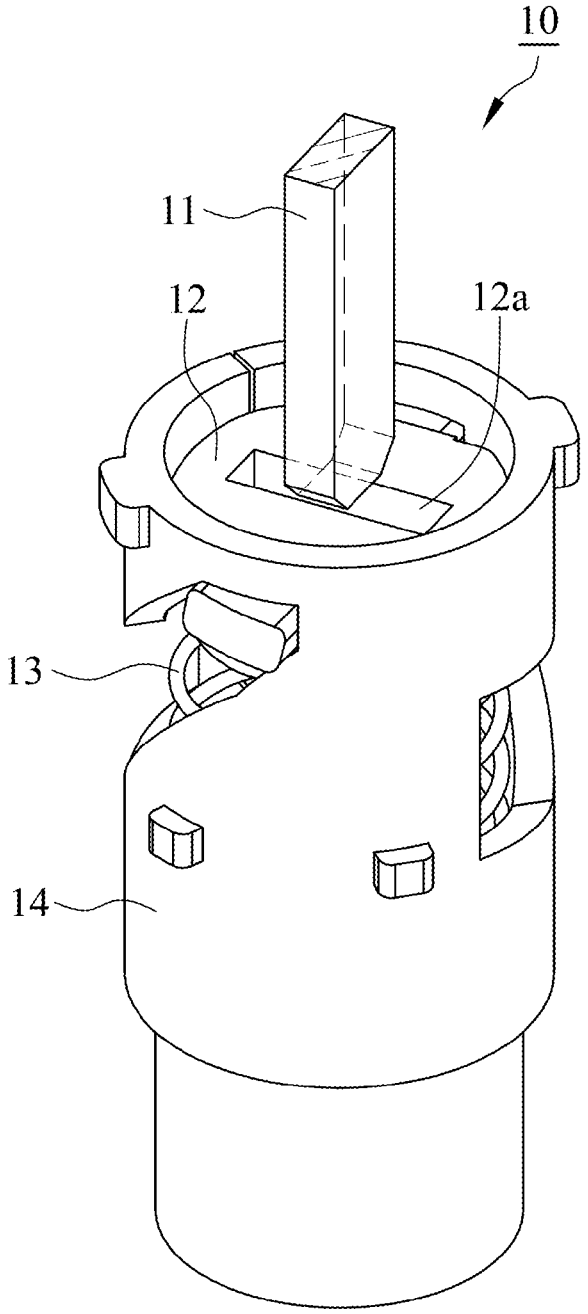
FIG. 22 PRIOR ART
FIG. 22 is perspective exploded diagram illustrating a conventional lock structure.

| | guidance mechanism A | driving plank 120 | actuation member 170 | |
|---|---|---|---|---|
| | | | push button | thumbturn |
| unlatch position | alignment hole 131 formed along vertical direction (FIG. 1) | vertical direction (FIG. 1) | pushed state (FIG. 20) | vertical direction (FIG. 21) |
| lock position | alignment hole 131 formed along transverse direction | transverse direction | non-pushed state | transverse direction |

The driving plank 120 is inserted into the opening A1 of the guidance mechanism A to make the guidance mechanism A and the driving plank 120 mutually coupled at the same unlatch position or mutually coupled at the same lock position through the guidance of the guidance track A2.

Figure 4:
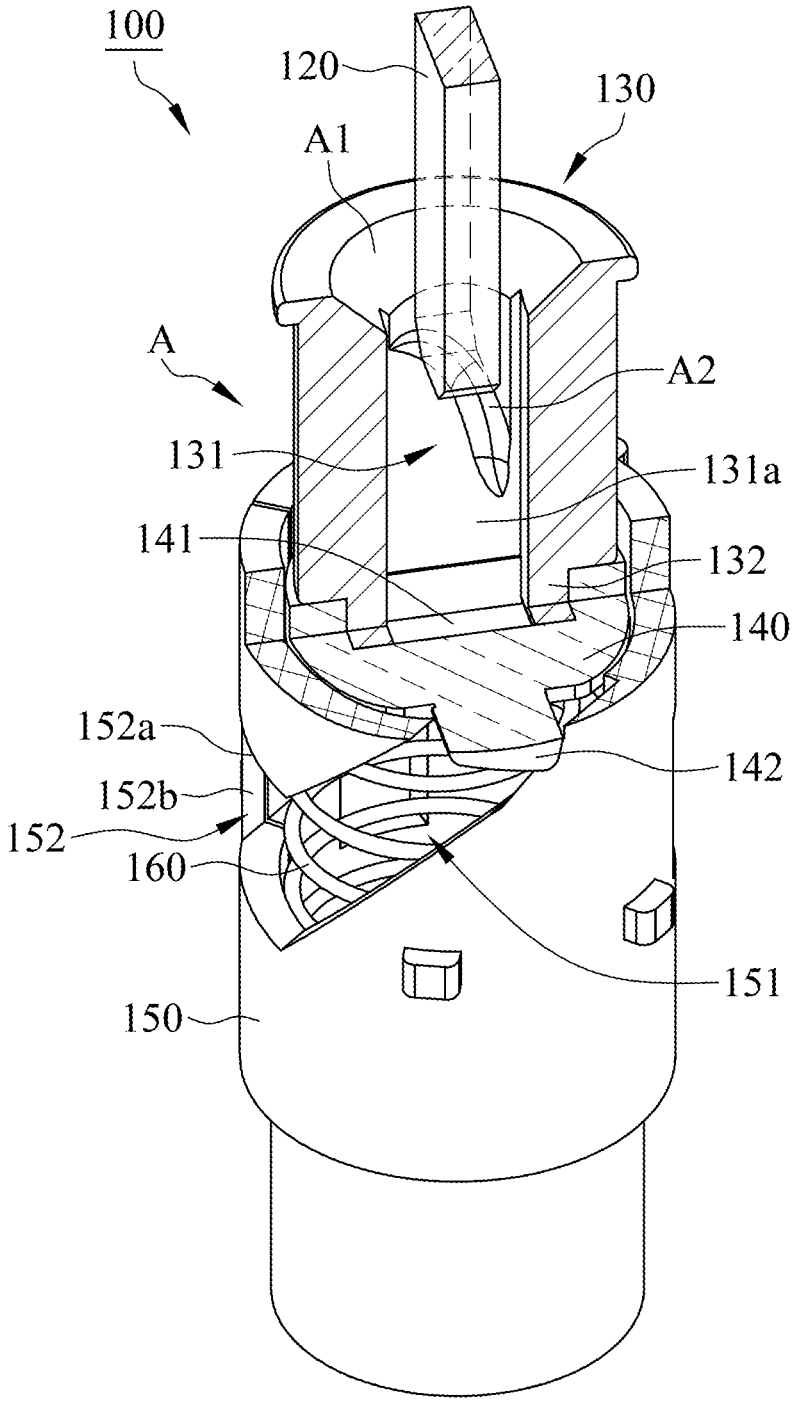
FIG. 4 is a partial section view illustrating a driving plank in contact with a leading barrel in accordance with a first embodiment of the present invention.

With reference to FIGS. 1 and 4, the leading barrel 130 is coupled to the unlatch plate 140, the leading barrel 130 and the unlatch plate 140 are synchronously rotatable, and the transmission hole 141 of the unlatch plate 140 is corresponded to the opening A1 and the alignment hole 131 of the leading barrel 130. The driving plank 120 is inserted into the leading barrel 130 via the opening A1 and penetrates through the alignment hole 131 and the transmission hole 141 via the guidance track A2. In this embodiment, the leading barrel 130 further comprises a coupling member 132, wherein the coupling member 132 can be a cylinder body or glue, and the leading barrel 130 is coupled to the unlatch plate 140 via the coupling member 132. In this embodiment, the coupling member 132 is a cylinder body and being lodged at the transmission hole 141 of the unlatch plate 140.

FIGS. 4 to 12 illustrate action diagrams regarding how the driving plank 120 correctly inserted into the transmission hole 141 of the unlatch plate 140 through the guidance of the guidance track A2.

Figure 6:
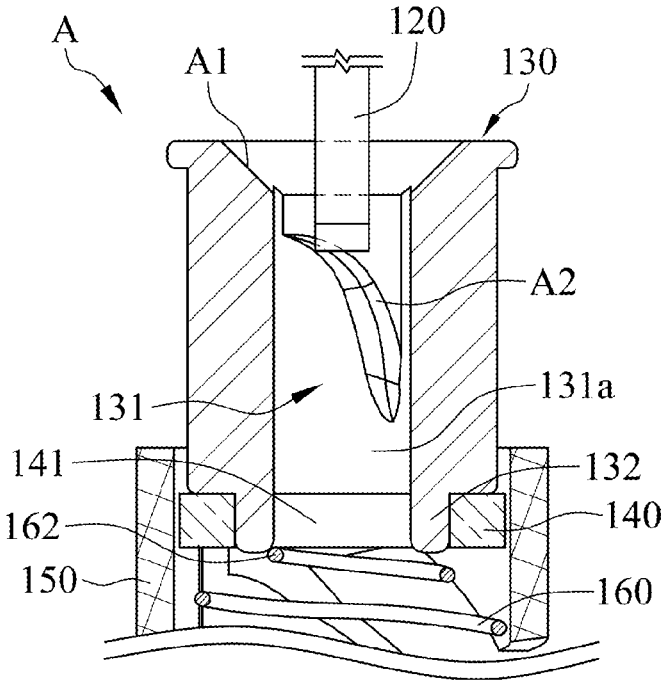
FIG. 6 is a section view illustrating a driving plank in contact with a leading barrel in accordance with a first embodiment of the present invention.

First, with reference to FIGS. 4, 5 and 6, in the process of the lock structure 100 installation, the driving plank 120 is firstly inserted into the leading barrel 130 via the opening A1. The section shape of the alignment hole 131 is the same with the section shape of the driving plank 120. The rectangular-shaped section driving plank 120 enables to enter the opening A1 smoothly at any rotation angle owning to the reason that the section of the opening A1 is round-shaped. Meantime, prior to the lock structure 100 installation by a consumer, an unlatch button of an inside lever may be unaware of being compressed by the consumer to make the installation direction of the driving plank 120 different from that of the transmission hole 141 of the unlatch plate 140. Therefore, the driving plank 120 can not be correctly inserted into the transmission hole 141 of the unlatch plate 140 through the alignment hole 131 so that the unlatch plate 140 can not actuate the driving plank 120 to switch into a lock state or an unlock state. The object of the present invention is to guide the driving plank 120 for making the installation direction between the driving plank 120 and the transmission hole 141 of the unlatch plate 140 become consistent. Accordingly, an issue for incapability of switching a lock state or an unlock state can be effectively resolved.

Figure 7:
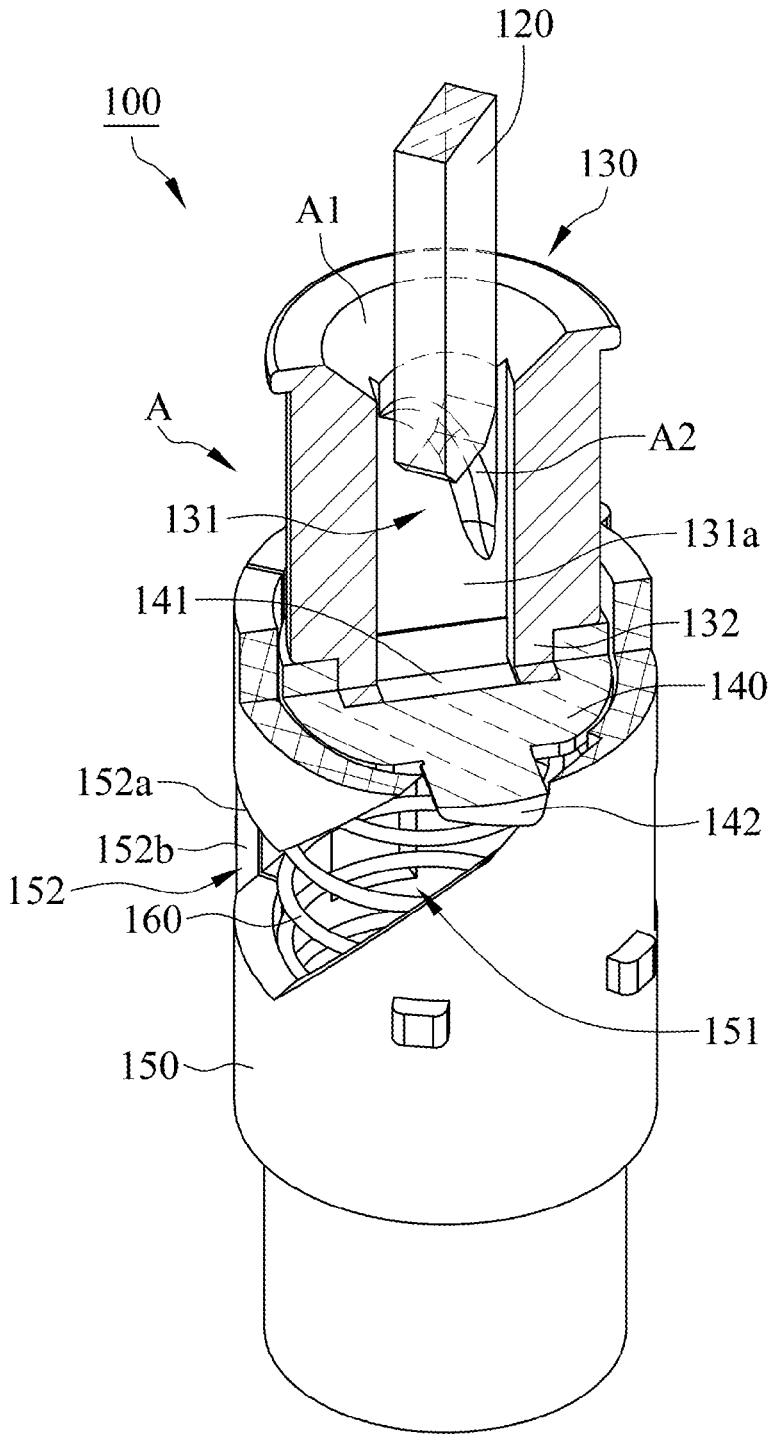
FIG. 7 is a partial section view illustrating a driving plank in contact with a guidance track of a guidance mechanism in accordance with a first embodiment of the present invention.
Figure 8:
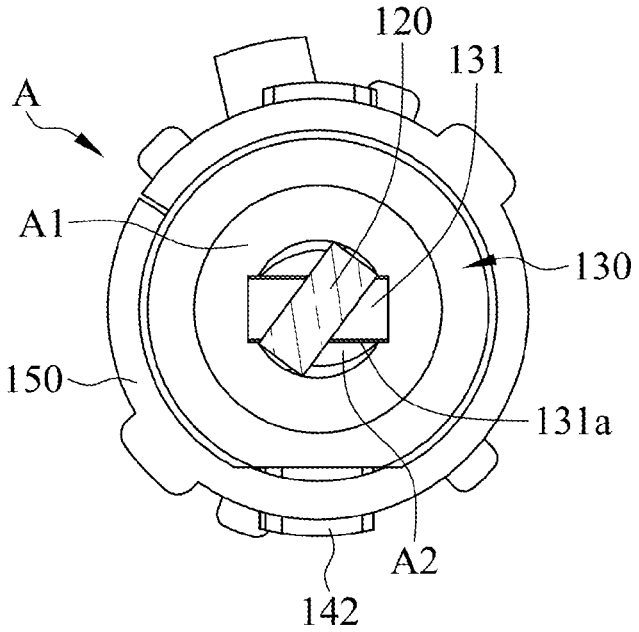
FIG. 8 is a top view illustrating a driving plank in contact with a guidance track of a guidance mechanism in accordance with a first embodiment of the present invention.
Figure 9:
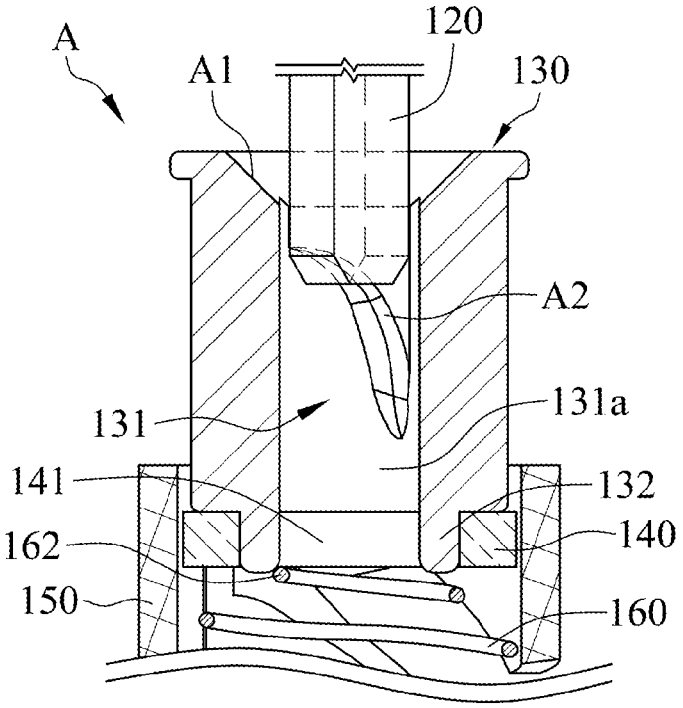
FIG. 9 is a section view illustrating a driving plank in contact with a guidance track of a guidance mechanism in accordance with a first embodiment of the present invention.

With reference to FIGS. 7, 8 and 9, owning to the guidance track A2 of the guidance mechanism A located between the opening A1 and the alignment hole 131, when the driving plank 120 is inserted into the leading barrel 130, even the installation direction of the driving plank 120 is different from that of the transmission hole 141 in the installation process, the driving plank 120 enables to gradually rotate via the guidance of the guidance track A2. Therefore, the installation direction of the driving plank 120 and the transmission hole 141 of the unlatch plate 140 becomes consistent.

Figure 10:
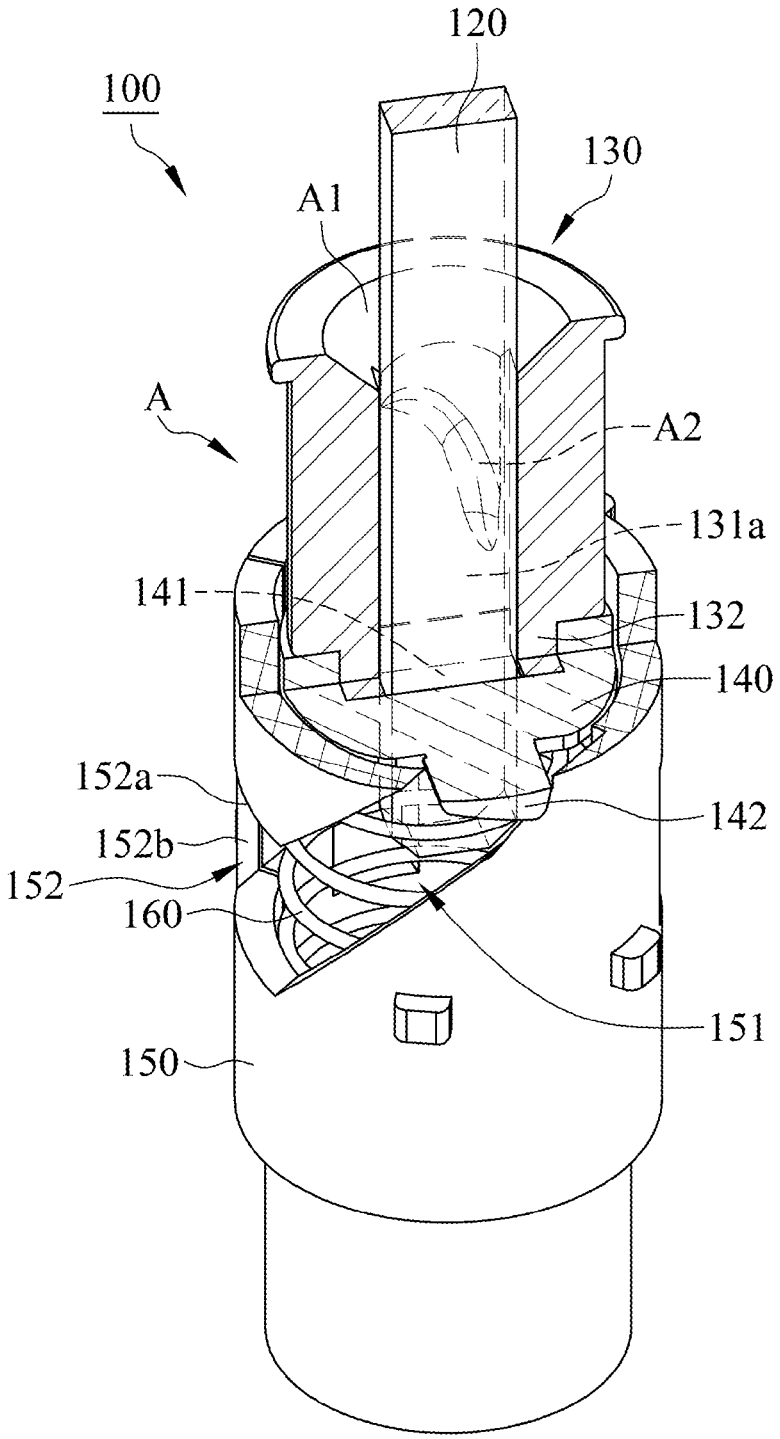
FIG. 10 is a partial section view illustrating a driving plank inserted into a transmission hole of an unlatch plate via a guidance track in accordance with a first embodiment of the present invention.
Figure 11:
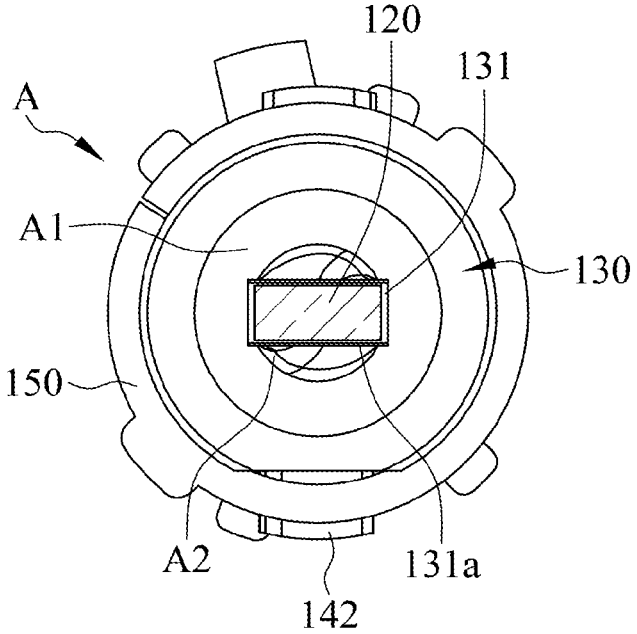
FIG. 11 is a top view illustrating a driving plank inserted into a transmission hole of an unlatch plate via a guidance track in accordance with a first embodiment of the present invention.
Figure 12:
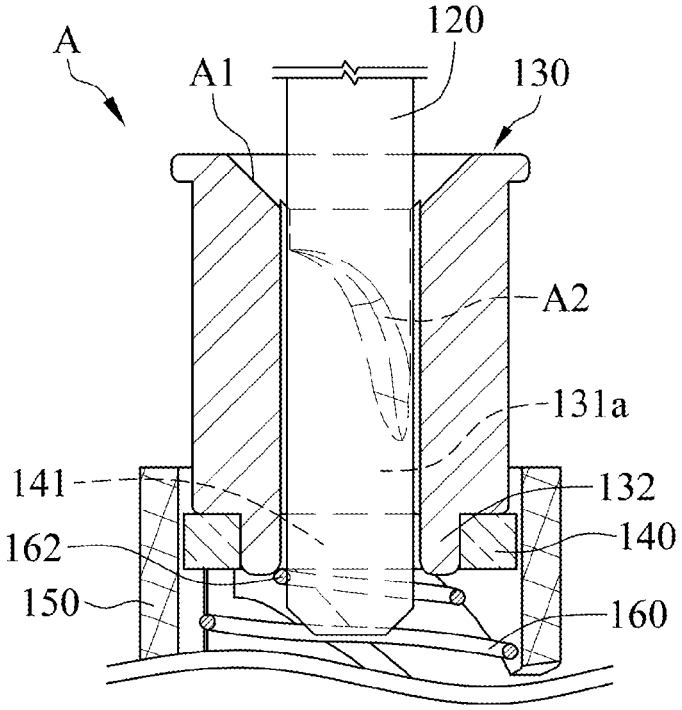
FIG. 12 is a section view illustrating a driving plank inserted into a transmission hole of an unlatch plate via a guidance track in accordance with a first embodiment of the present invention.

Then, referring to FIGS. 10, 11 and 12, the driving plank 120 gradually rotates into a correct installation angle along the guidance track A2 and penetrates through the alignment hole 131 so as to be inserted into the transmission hole 141 of the unlatch plate 140.

In this embodiment, the driving plank 120 rotates toward the alignment hole 131 via the guidance of the guidance track A2 and correctly penetrates through the alignment hole 131 of the leading barrel 130. Besides, the driving plank 120 correctly penetrates through the transmission hole 141 of the unlatch plate 140 via the alignment hole 131 so as to make the installation direction of the driving plank 120 and the unlatch plate 140 become consistent. In mentioned feature, the driving plank 120 not inserted into the transmission hole 141 of the unlatch plate 140 can be effectively prevented to avoid a condition that the unlatch plate 140 can not actuate the driving plank 120 to switch into a lock state or an unlock state.

Furthermore, a wrong installation for the driving plank 120 resulting in destruction of the lock structure 100 or reinstallation can be avoidable.

Figure 13:
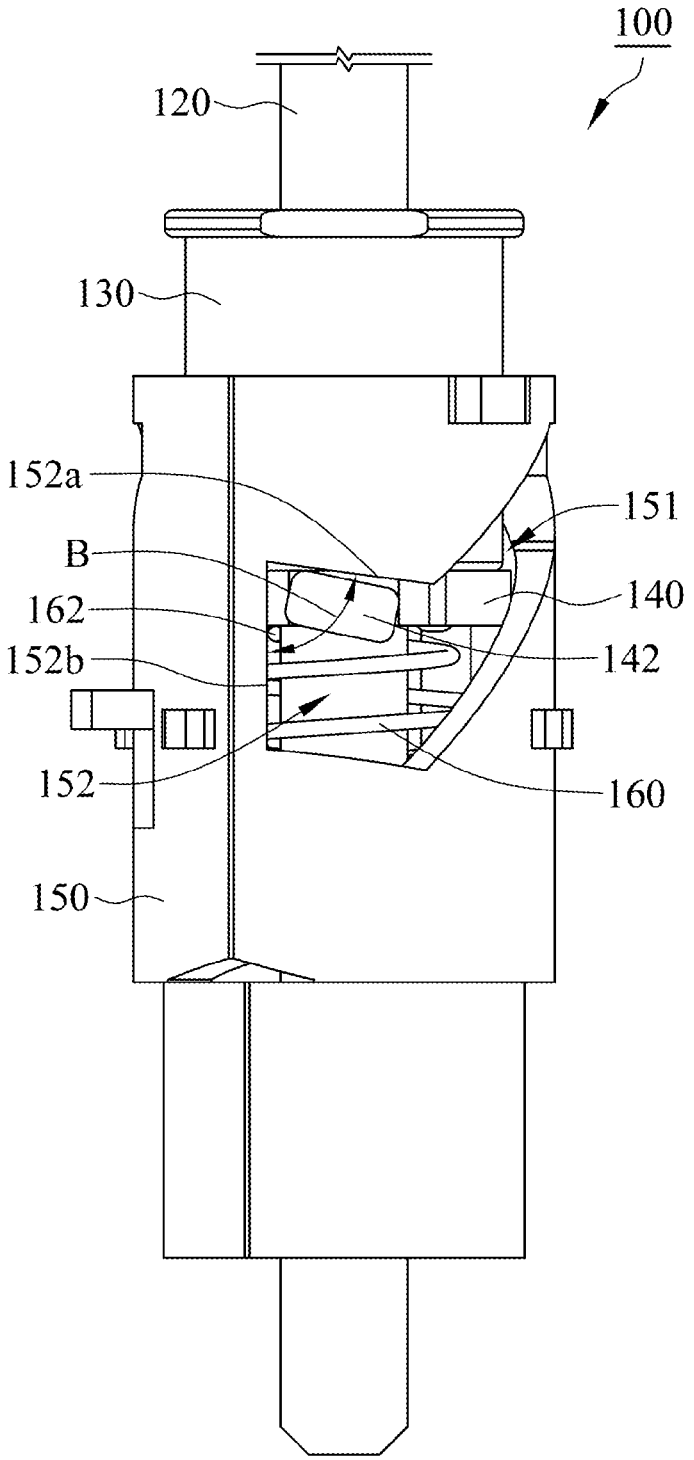
FIG. 13 is a lateral view illustrating a side plate of an unlatch plate being limited at an alignment slot of a control barrel in accordance with a first embodiment of the present invention.

With reference to FIG. 13, in this embodiment, the side plate 142 of the unlatch plate 140 is movable within the guiding slot 151 and the alignment slot 152, the alignment slot 152 includes a supporting surface 152*a* and a bottom surface 152*b*, and a major axis direction of the bottom surface 152*b* is substantially parallel to the driving plank 120. An included angle B between the bottom surface 152*b* and the supporting surface 152*a* is less than 90 degrees to enable the supporting surface 152*a* to form a ramp surface relative to the bottom surface 152*b*, and the supporting surface 152*a* is a joint portion between a distal end of the guiding slot 151 and the bottom surface 152*b*. When the side plate 142 of the unlatch plate 140 is located at the alignment slot 152, the elastic member 160 compresses the side plate 142 of the unlatch plate 140 to make the side plate 142 in contact against the supporting surface 152*a* of the alignment slot 152 to switch the lock structure 100 into a lock state. However, the unlatch plate 140 is compressed by the elastic member 160 for the reasons that the supporting surface 152*a* is a ramp surface, and the supporting surface 152*a* extends downwardly relative to the distal end of the guiding slot 151, when the side plate 142 of the unlatch plate 140 bears the compression of the elastic member 160, the side plate 142 is movable toward the bottom surface 152*b* along the supporting surface 152*a*. Comparatively, the side plate 142 is difficult to climb across the distal end of the guiding slot 151 along the supporting surface 152*a*. Accordingly, the side plate 142 of the unlatch plate 140 is limited at the supporting surface 152*a* of the alignment slot 152. When the lock structure 100 is beaten by external force, the side plate 142 of the unlatch plate 140 does not slide toward the guiding slot 151 to avoid switching into an unlock state.

Figure 14:
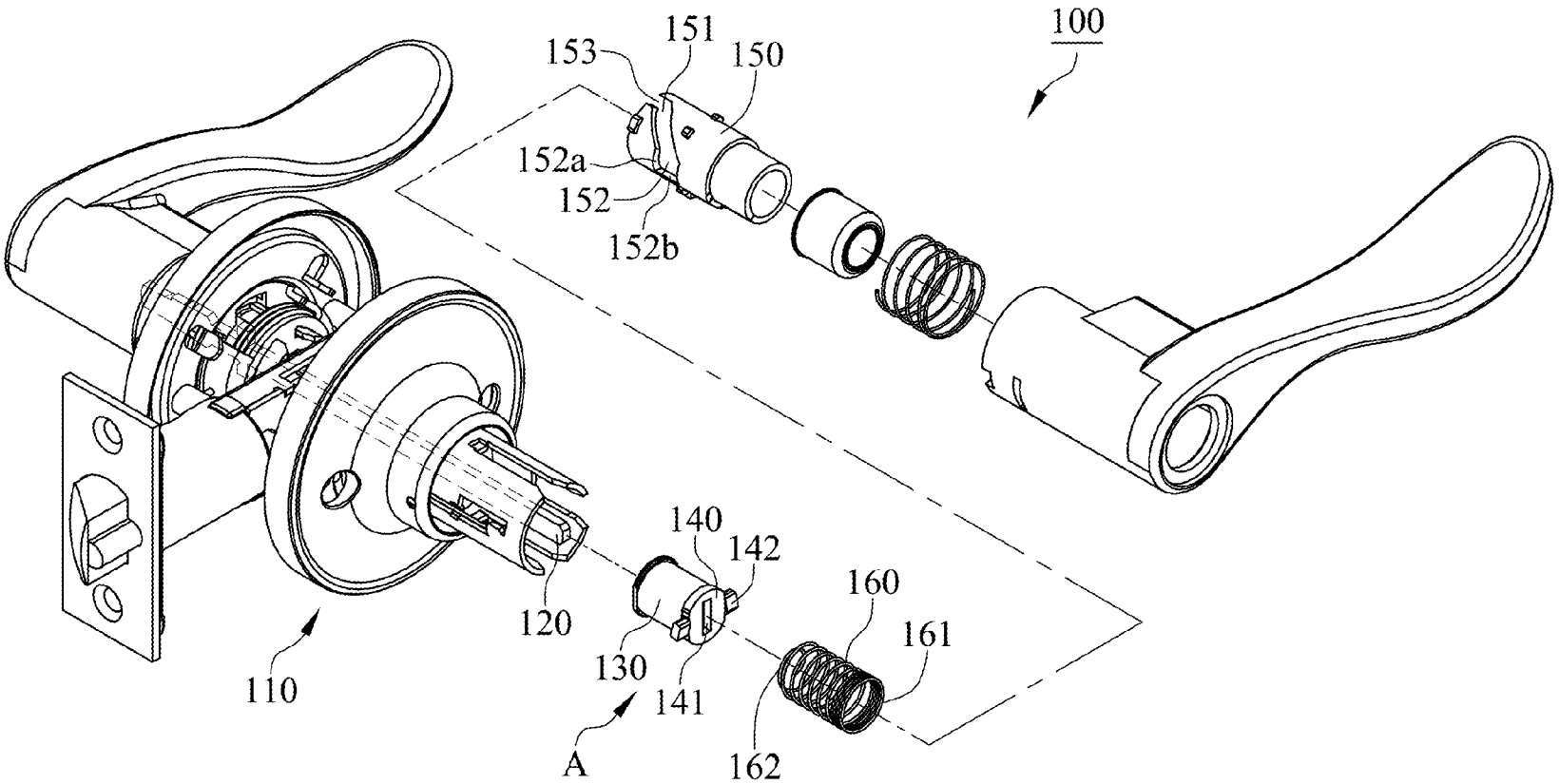
FIG. 14 is a perspective exploded diagram illustrating a lock structure in accordance with a second embodiment of the present invention.
Figure 15:
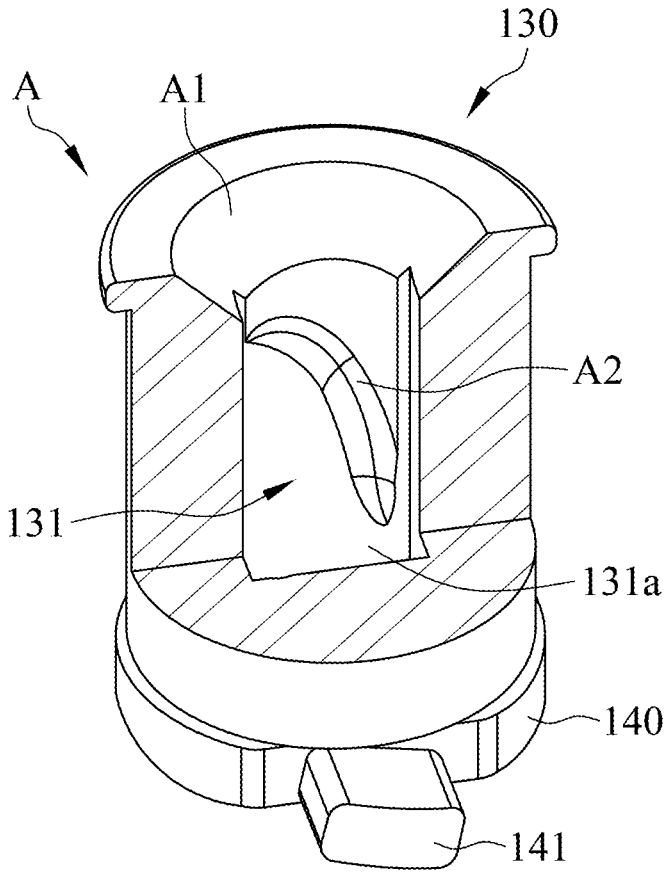
FIG. 15 is a perspective section view illustrating a leading barrel in accordance with a second embodiment of the present invention.

FIGS. 14 and 15 illustrate a second embodiment of the lock structure 100 in the present invention. The primary difference between the second embodiment and the first embodiment is that the leading barrel 130 and the unlatch plate 140 are formed into one piece. Preferably, the material of the control barrel 150 is the same with that of the leading barrel 130 and the unlatch plate 140, and an installation opening 153 in communication with the guiding slot 151 is formed at a distal end of the control barrel 150. The side plate 142 of the unlatch plate 140 may be installed at the guiding slot 151 through the installation opening 153.

Figure 16:
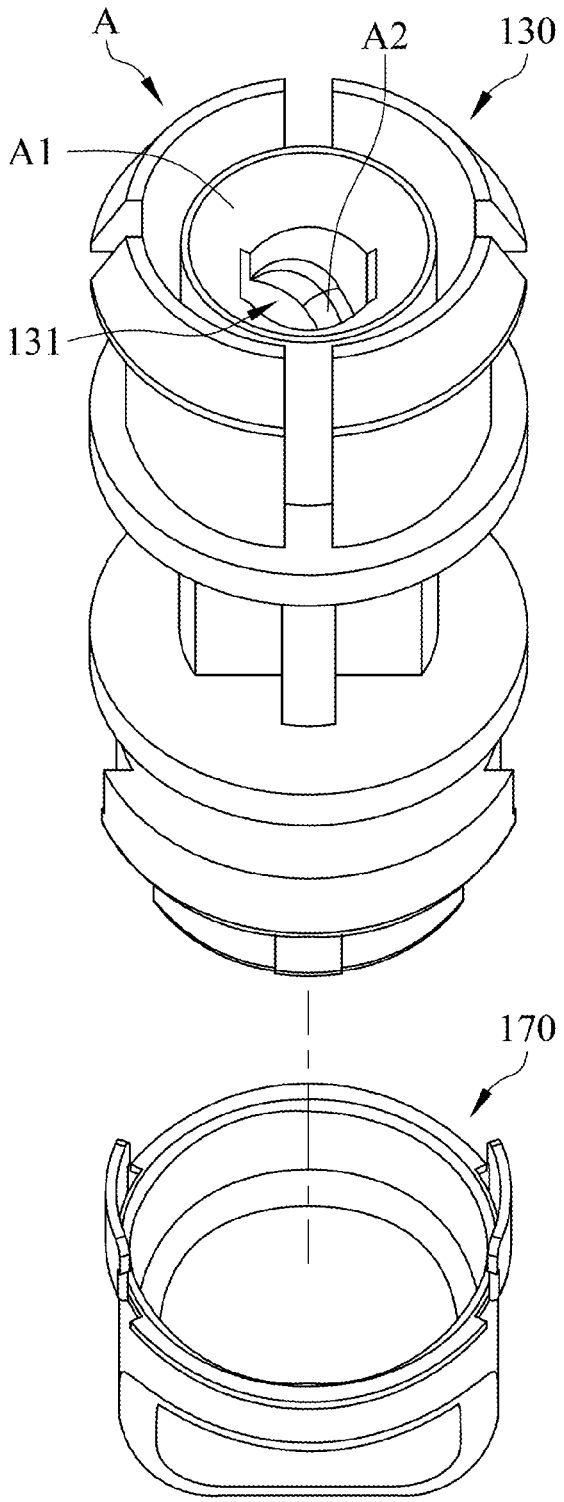
FIG. 16 is a perspective exploded diagram illustrating a leading barrel and an actuation member in accordance with a third embodiment of the present invention.
Figure 17:
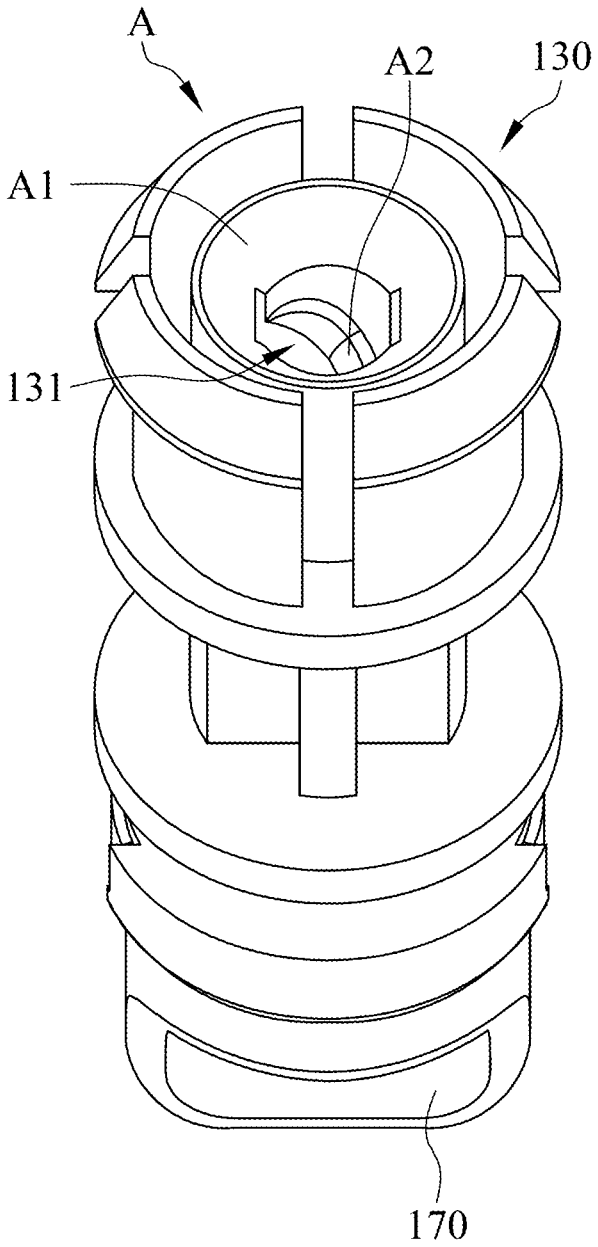
FIG. 17 is a perspective assembly diagram illustrating a leading barrel and an actuation member in accordance with a third embodiment of the present invention.

FIGS. 16 and 17 illustrate a third embodiment of the lock structure 100 in the present invention. The actuation member 170 of the lock structure 100 is utilized to control the driving plank 120 to be rotatable between the unlatch position and the lock position. The primary difference between the third embodiment and the first embodiment is that the leading barrel 130 of the guidance mechanism A couples to the actuation member 170, wherein the actuation member 170 and the leading barrel 130 are synchronously rotatable. From comparison between the third embodiment and the first embodiment, the actuation member 170 is a thumbturn in the third embodiment, and the actuation member 170 is a push button in the first embodiment. In the first embodiment, the actuation member 170 is configured to drive the driving plank 120 from the unlatch position to the lock position, and the guidance mechanism A of the lock structure 100 is rotatable from the unlatch position to the lock position in response to the action of the actuation member 170.

Figure 18:
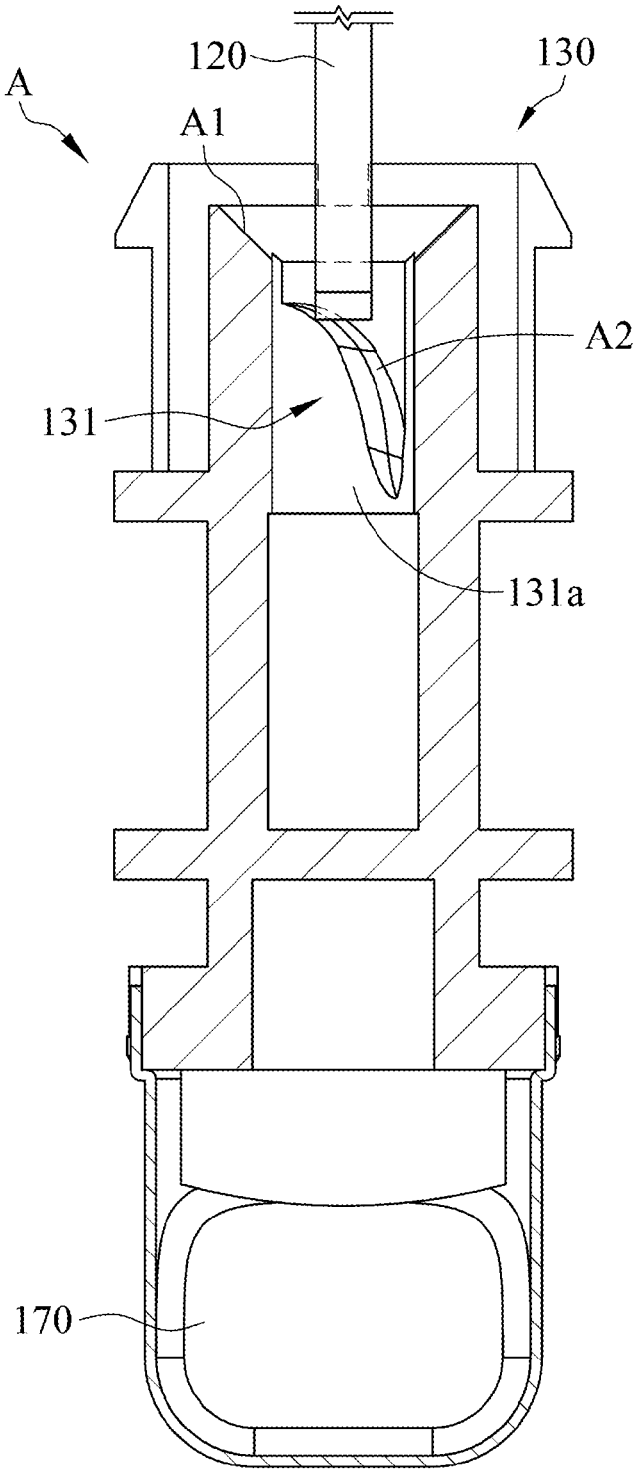
FIG. 18 is a section view illustrating a driving plank in contact with a leading barrel in accordance with a third embodiment of the present invention.

Prior to the lock structure 100 installation by a consumer, the actuation member 170 may be unaware of being compressed by the consumer to make the leading barrel 130 rotatable in advance so that the installation direction of the driving plank 120 is different from that of the leading barrel 130. The driving plank 120 is likely jammed within the leading barrel 130 and being difficult to actuate the driving plank 120 to switch into a lock state or an unlock state. With reference to FIGS. 17 and 18, in order to solve this problem, when the driving plank 120 is inserted into the guidance mechanism A, the driving plank 120 enables to rotate relative to the guidance mechanism A from an unmatched position where one of the driving plank 120 and the guidance mechanism A is at the unlatch position and another is at the unlatch position to a matched position where both of the driving plank 120 and the guidance mechanism A are at the unlatch position or at the lock position (e.g. the driving plank 120 situated in the unlatch position, and the guidance mechanism A situated in the unlatch position as well; or the driving plank 120 situated in the lock position, and the guidance mechanism A situated in the lock position as well), thereafter, the driving plank 120 couples to the guidance mechanism A. Or, the guidance mechanism A enables to rotate relative to the driving plank 120 from the unmatched position where one of the driving plank 120 and the guidance mechanism A is at the unlatch position and another is at the unlatch position to the matched position where both of the driving plank 120 and the guidance mechanism A are at the unlatch position or at the lock position, thereafter, the guidance mechanism A couples to the driving plank 120.

Figure 19:
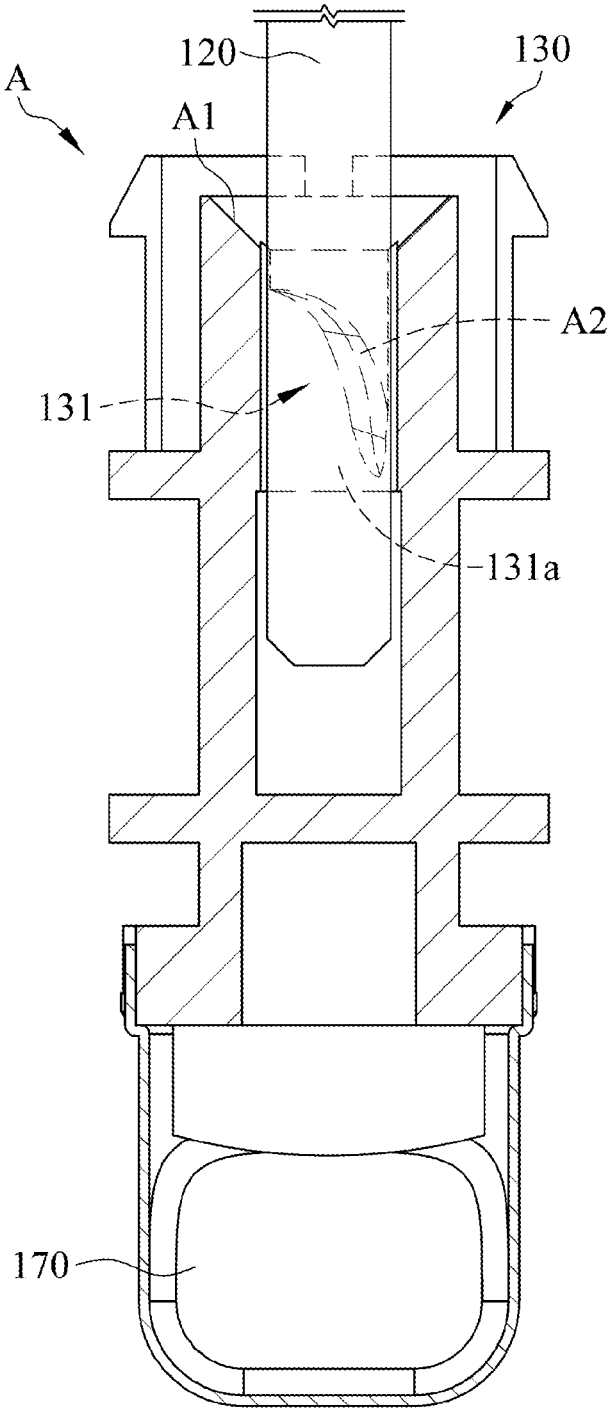
FIG. 19 is a section view illustrating a driving plank being inserted into a leading barrel in accordance with a third embodiment of the present invention.

With reference to FIGS. 17 and 18, the actions in this embodiment are illustrated as below, the guidance track A2 of the guidance mechanism A is in communication with the opening A1 and the alignment hole 131, when the driving plank 120 is not aligned with the alignment hole 131 of the leading barrel 130, the driving plank 120 contacts against the guidance track A2 of the guidance mechanism A. Referring to FIG. 19, when the driving plank 120 is inserted into the leading barrel 130, the driving plank 120 gradually rotates toward the alignment hole 131 through the guidance of the guidance track A2. The driving plank 120 is then correctly inserted into the alignment hole 131 via the guidance of the guidance track A2. In this embodiment, the driving plank 120 gradually rotates into a correct installation angle along the guidance track A2, which resolves a condition that the driving plank 120 is likely jammed within the leading barrel 130 and being difficult to actuate the driving plank 120 to switch into a lock state or an unlock state. Furthermore, a wrong installation for the driving plank 120 resulting in destruction of the lock structure 100 or reinstallation can be avoidable.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. A lock structure comprising:

a driving plank rotatable between an unlatch position and a lock position;

a guidance mechanism rotatable between the unlatch position and the lock position, wherein the guidance mechanism includes a leading barrel, an unlatch plate with a transmission hole, an opening disposed at the leading barrel and a guidance track which is a spiral track, wherein the leading barrel and the unlatch plate are synchronously rotatable, the leading barrel includes an alignment hole comprising a lateral surface, the guidance track is disposed at the lateral surface of the alignment hole, and the driving plank inserts into the leading barrel via the opening so as to rotate gradually via guidance of the guidance track and penetrates through the transmission hole;

a control barrel wherein the unlatch plate is disposed within the control barrel;

an elastic member disposed within the control barrel; and an actuation member configured to drive the driving plank to be rotatable between the unlatch position and the lock position.

2. The lock structure in accordance with claim 1, wherein the leading barrel and the unlatch plate are formed as one piece.

3. The lock structure in accordance with claim 1, wherein the leading barrel couples to the unlatch plate, the guidance track is in communication with the opening and the alignment hole, the transmission hole is corresponded to the alignment hole, and the driving plank is penetrated through the alignment hole.

4. The lock structure in accordance with claim 1, wherein the section of the driving plank is rectangular-shaped, the section of the opening is round-shaped, and the section shape of the alignment hole is the same with the section shape of the driving plank.

5. The lock structure in accordance with claim 1, wherein the leading barrel comprises a coupling member lodged at the transmission hole of the unlatch plate.

6. The lock structure in accordance with claim 1, wherein the control barrel has a guiding slot and an alignment slot in communication with the guiding slot, and the unlatch plate comprises a side plate, the alignment slot includes a supporting surface and a bottom surface, an included angle between the bottom surface and the supporting surface is less than 90 degrees, and the side plate contacts against the supporting surface of the alignment slot.

7. The lock structure in accordance with claim 6, wherein the elastic member comprises a first end portion and a second end portion, the first end portion contacts against the control barrel, and the second end portion contacts against the unlatch plate.

8. A guidance mechanism of a lock structure comprising:

a leading barrel having an alignment hole with a lateral surface;

an unlatch plate having a transmission hole, wherein the leading barrel and the unlatch plate are synchronously rotatable;

an opening disposed at the leading barrel; and a guidance track disposed at the lateral surface of the alignment hole, wherein the guidance track is a spiral track;

wherein a driving plank of the lock structure inserts into the leading barrel via the opening, rotates gradually via guidance of the guidance track and penetrates through the transmission hole.

9. The guidance mechanism of a lock structure in accordance with claim 8, wherein the leading barrel and the unlatch plate are formed as one piece.

10. The guidance mechanism of a lock structure in accordance with claim 8, wherein the leading barrel couples to the unlatch plate, and the guidance track is in communication with the opening and the alignment hole, the transmission hole is corresponded to the alignment hole, and the driving plank penetrates through the alignment hole.

11. The guidance mechanism of a lock structure in accordance with claim 8, wherein the leading barrel comprises a coupling member lodged at the transmission hole of the unlatch plate.

* * * * *